United States Patent [19]

Sander et al.

[11] 4,110,385

[45] Aug. 29, 1978

[54] MANUFACTURE OF FIBRIDS OF POLYOLEFINS

[75] Inventors: Bruno Sander, Ludwigshafen; Eckhard Bonitz, Frankenthal; Kurt Scherling, Hemsbach, all of Fed. Rep. of Germany

[73] Assignee: BASF Aktiengesellschaft, Ludwigshafen am Rhein, Fed. Rep. of Germany

[21] Appl. No.: 714,404

[22] Filed: Aug. 16, 1976

Related U.S. Application Data

[63] Continuation of Ser. No. 532,193, Dec. 12, 1974, abandoned.

[30] Foreign Application Priority Data

Dec. 21, 1973 [DE] Fed. Rep. of Germany ..... 2363672

[51] Int. Cl.[2] ..... D21F 11/00

[52] U.S. Cl. ..... 264/13; 162/157 R; 264/140; 528/502

[58] Field of Search ..... 264/13, 14, 140; 162/157; 528/502, 503, 497

[56] References Cited

U.S. PATENT DOCUMENTS

| | | | |
|---|---|---|---|
| 2,965,629 | 12/1960 | Fawcett | 528/497 |
| 3,081,519 | 3/1963 | Blades et al. | 57/140 |
| 3,891,499 | 6/1975 | Kato et al. | 264/13 |
| 3,950,293 | 4/1976 | Sanders et al. | 260/29.6 RW |
| 3,960,794 | 6/1976 | Sanders et al. | 162/157 R |
| 3,992,344 | 11/1976 | Sanders et al. | 260/29.6 RW |
| 3,995,001 | 11/1976 | Vroomans et al. | 162/157 R |

*Primary Examiner*—Jay H. Woo

*Attorney, Agent, or Firm*—Keil, Thompson & Shurtleff

[57] ABSTRACT

Fibrids of polyolefins showing a high degree of fibrillation and a high specific surface area are obtained by flashing a pressurized solution of polyolefin in pentane or in a pentane-containing solvent mixture at a temperature above the boiling point of the solvent by passing said solution through an orifice into a space which is at a lower pressure and in which shearing forces are applied to said solution. The fibrids directly obtained may be used, for example, for the manufacture of paper or for the manufacture of textile-like webs.

4 Claims, No Drawings

MANUFACTURE OF FIBRIDS OF POLYOLEFINS

This is a continuation of application Ser. No. 532,193 filed Dec. 12, 1974 now abandoned.

This application discloses and claims subject matter described in German Patent Application No. P 23 63 672.8, filed Dec. 21, 1973, which is incorporated herein by reference.

This invention relates to a process for the manufacture of fibrids of polyolefins by dissolving a polyolefin in an organic solvent under pressure and at a temperature which at standard pressure is above the boiling point of the solvent, and flashing the solution by passing it through an orifice into a space which is at a lower pressure.

Fibrids of polyethylene are produced, for example, by dissolving polyethylene in an organic solvent at an elevated temperature under pressure and then flashing the solution through a nozzle. The primary products are coherent masses of fibers or plexus filaments (German Published Application No. 1,290,040) or fibrous gel (German Published Applications Nos. 2,117,370; 2,227,021 and 2,237,606).

In order to obtain fibrids from the plexus filaments or the coherent masses, it is first necessary to cut these into staple lengths and then to disentangle them in liquids by the action of high shearing forces to obtain discrete fibrids. The fibrids liberated in this manner are relatively short and show only a low degree of fibrillation.

The fibrous gels contain a high proportion of solvent and turn into hard crumbly masses, no longer of a fibrous nature, when left in the air. The fibrous gels shrink and stick together when left in the air.

However, discrete fibrids may be obtained from the fibrous gels if the solvent-containing gel is subjected to the action of mechanical shearing forces in a liquid medium. The liquid medium consists of solvent and/or dispersion-containing water.

On removal of the liquid medium, the residual solvent and/or water is removed from the disentangled fibrids by evaporation or by steam distillation. However, this must be effected in the presence of surfactants such as polyhydroxyl compounds (German Published Application No. 2,237,606) and, possibly, anti-foaming agents, as the heat treatment will otherwise cause the fibrids to agglomerate and lose their fibrous character. The solvent-free fibrids contain a high proportion of auxiliaries and therefore have only restricted application. For example, when sheets of paper are prepared from polyolefin fibrids obtained in this manner, fiber bonding and the initial wet strength of the sheets are impaired by the presence of surfactants and anti-foaming agents.

In another well-known process, the solvent residues are removed by solvent exchange. In this method, the solvents, primarily cyclohexane and n-hexane, are replaced, in a first extraction stage, by some other solvent, such as isopropanol, which is then washed out in a second extraction stage by means of water. This method is expensive and time-consuming.

The fibrids obtained by the prior art processes cannot be disentangled, for example with the aid of an opener, willey, card or spiked rollers.

It is an object of the invention to modify the process described above in such a manner that the drawbacks of the prior art processes are obviated. It is desired to produce, directly, fibrids which are morphologically similar to cellulose fibers. This means that they should have a high degree of fibrillation, should have a high specific surface area, should not agglomerate on evaporation of the solvent, should not (substantially when left in the air and should be capable of being isolated in the absence of auxiliaries.

This object is achieved, according to the invention, by using, as solvent, pentane or a solvent mixture containing at least sufficient pentane to cause the polyolefine to separate in the form of discrete fibrids when the solution is relaxed. Unlike the prior art processes, this method produces individual fibrillated fibrids. They are produced as a tangled mass. Surprisingly, the polyolefin fibrids of the invention do not agglomerate when, for example dried at an elevated temperature or when the residual solvent is distilled off from an aqueous fiber suspension.

The immediate product is a fiber which is no longer swollen by solvent. No fibrous gel is formed.

By polyolefins, we mean for example partially crystalline polymers, particularly polymers of olefins of from 2 to 8 carbon atoms. Suitable partially crystalline olefin polymers have an X-ray crystallinity of more than 5% w/w at a temperature of 25° C. We prefer to use polyethylenes having densities of from 0.915 to 0.965 g/cm$^3$ and polypropylene. The molecular weight of the polyethylenes is characterized by their melt index, the maximum molecular weight being indicated by a melt index of 0.01 g/10 min (as measured at a temperature of 190° C and a load of 21.6 kg), and the minimum molecular weight being indicated by a melt index of 100 g/10 min (190° C/2.16 kg). The melt index is determined by the method laid down in ASTM D 1238-65 T. The polyethylenes are produced by the well-known high-pressure and low-pressure polymerization processes. They are commercially available, as is polypropylene, the molecular weight of which is characterized by an intrinsic viscosity of, preferably, from 1.5 to 8 dl/g (as measured in decalin at 130° C).

Also suitable are copolymers of ethylene with other ethylenically unsaturated compounds, for example copolymers of ethylene and propylene, copolymers of ethylene and butylene, copolymers of ethylene and 4-methylpentene-1 and copolymers of ethylene and vinyl esters derived, for example, from saturated carboxylic acids of from 2 to 4 carbon atoms, copolymers of ethylene and acrylates of from 1 to 3 carbon atoms, copolymers of ethylene and methacrylates of from 1 to 8 carbon atoms, copolymers of ethylene and fumaric acids, maleic acid, itaconic acid and their esters, and copolymers containing polymerized units of acrylic acid and methacrylic acid. Particularly significant are copolymers of ethylene and vinyl acetate, copolymers of ethylene and n-, iso- or tert.-butylacrylate, copolymers of ethylene and acrylic acid and copolymers containing polymerized units of 2 or more of said ethylenically unsaturated comonomers, for example comonomers of ethylene, acrylic acid and vinyl acetate and comonomers of ethylene, acrylic acid and tert.-butyl acrylate. It is, of course, also possible to produce fibrids from mixtures of various polymers, for example from a blend of high-pressure and low-pressure polyethylenes at a ratio of 1:1 or a blend of 80% of high-pressure polyethylene and 20% w/w of an ethylene-vinyl acetate copolymer having a vinyl acetate content of 15% by weight. Usually, the ethylene copolymers contain up to 50% w/w of one or more conomoners, preferably from 5 to 40% w/w of comonomers.

According to the invention, the solvent used for the polyolefins is pentane or a solvent mixture containing pentane. For the purposes of the present invention, we mean, by pentane, all isomers of pentane such as n-pentane, isopentane, cyclopentane and neopentane. Use will usually be made of an isomeric mixture, for example a mixture of n-pentane and isopentane, although pure n-pentane, isopentane or neopentane may of course be used.

Also suitable for the process of the invention are solvent mixtures containing at least sufficient pentane to cause the polyolefin to separate in the form of discrete fibrids when the homogeneous solution is flashed in a space which is at a lower temperature. Suitable solvent mixtures are obtained by adding pentane to organic solvents capable of dissolving polyolefins. Organic solvents for polyolefins are for example cyclohexane, methylcyclohexane, n-hexane, n-heptane, n-octane, isooctane and aromatic hydrocarbons such as benzene, toluene, xylene, ethylbenzene and chlorinated hydrocarbons such as methylene chloride, trichloromethane, tetrachloroethylene and chlorobenzene.

Particularly suitable solvents are naphtha cuts boiling at from 25° to 140° C. Particularly advantageous are ligroin (b.p. 30° to 60° C) and low-boiling naphtha (b.p. 55° to 95° C). Mixtures of said solvents may also be used if desired.

In order to obtain fibrids from the polyolefins, the latter are dissolved in an organic solvent. The solubility of the polyoefins in said organic solvent is greatly dependent on the temperature. In order to obtain a highly concentrated solution, the polyolefin is preferably dissolved at a temperature which is above the boiling point of the solvent used. It is therefore necessary to produce the polyolefin solution in a pressure vessel. For example, this may be a stirred pressure tank, or the polyolefin may first be melted in a screw machine, e.g. a twin-shaft screw kneader, the molten polyolefin then being mixed with the solvent under pressure. In order to obtain fibers from the polyolefin solutions in accordance with the present invention, the concentration of the polyolefin in the solution may be from 0.5 to 30% and preferably from 10 to 25% by weight.

The amount of pentane required in the solvent mixture is dependent on the molecular weight and molecular weight distribution of the polyolefin used, on the solvent action of the solvent used and on the processing conditions. The required amount of pentane in the solvent mixture may be readily determined, for each polyolefin, by simple tests in which, for example, polyethylene is dissolved, with heating, in various cyclohexane-pentane mixtures and observations are made to discover the mixtures from which the polyethylene no longer separates in a gelled condition. Suitable solvent-pentane mixtues may contain for example up to 98% by weight of pentane.

We prefer to use naphtha cuts as organic solvents, these containing from 5 to 50% and preferably from 10 to 30% by weight of pentane. In order to obtain maximum concentrations of polyolefin in the solution, those solvents are added to pentane which are very good solvents for the polyolefins.

According to the invention, the polyolefin solutions are generally prepared in such proportions that the vapor pressure above the mixture is from about 4 to 60 and preferably from 10 to 20 atmospheres at temperatures of from 80° to 250° C and preferably from 100° to 180° C. However, the solution may be prepared at lower temperatures and/or under inert gas pressure, for example nitrogen pressure of up to 60 atmospheres.

The homogeneous polyolefin solutions are then flashed by passage through an orifice, for example a nozzle or a tube, into a space which is at a lower pressure. Preferably, the polyolefin solution is flashed in a nitrogen-filled chamber. The pressure in that chamber may be atmospheric or subatmospheric.

Alternatively, however, the homogenous solution may be flashed in a container containing a precipitant such as the same solvent or solvent mixture as that in which the polyolefin is dissolved. Alternatively, the space in which the homogeneous solution is flashed may, if desired, be filled with water or an organic solvent known to be a non-solvent for the polyolefin used.

Suitable non-solvents (precipitants) are for example water, acetone, methylethylketone, methanol, isopropanol and n-hexanol. Naphtha cuts and pentane, which function as solvents in the above polyolefin solutions at 80°–250° C and 4 to 60 atmospheres pressure, are suitable non-solvents (precipitants) at conditions in the flashing chamber, i.e., atmospheric pressure and lower temperature.

The orifice through which the homogeneous solution is flashed may have any desired cross-section and any desired geometrical shape. If, for example, a cylindrical tube is used, the internal diameter of said tube can be, for example, from 1 to 20 and preferably from 3 to 10 mm.

If the homogeneous solution is flashed, for example, in a space filled with one of the above liquids acting as precipitant, a constant level of liquid may be maintained above the outlet of the tube through which the solution is passed. Flashing of the pressurized polymer solution is preferably carried out isothermally with evaporative cooling, the excess heat being removed by means of a cooler. The resulting slurry of fibrids is adjusted, if necessary, to a different density, for example, one at which the product may be hydraulically transported, by the addition of further amounts of the solvent in which the polymer is dissolved.

In another embodiment of the process of the invention, the polyolefin solution is flashed by passage into a cylindrical chamber either tangentially or centrally thereto. This chamber is at the top of a vertical tube, down which the fibrids fall when the solvent has evaporated. The solvent vapors released by the flash are condensed by cooling. The fibrids formed by the flash are dried by means of warm nitrogen which is passed countercurrently through the tube arrangement. Virtually solvent-free polyolefin fibrids are discharged at the bottom of the tube.

If, in the process of the invention, a mush of fibrids is obtained, the fibrids are substantially separated from the solvent for example by evaporation, filtration, centrifuging and suction or pressure filtering. The solvent may be immediately re-used.

If desired, the fibrids of the invention may be disentangled immediately after drying by combing, brushing or picking. The fibrids thus obtained are free-flowing and transportable. They show high values of specific surface area, these being from about 10 to 50 $m^2/g$ (as measured by the BET-method by nitrogen adsorption). The lengths of the fibrids are generally from 1 to 40 mm and their thickness is between 2 and 30 $\mu$m.

However, the main advantage of the process of the invention is that it is no longer necessary to disentagle the coherent mass of fibrids or a gel by mechanical means. It is thus no longer necessary to add dispersing or stabilizing auxiliaries or an additional solvent for solvent exchange in order to obtain discrete solvent-free fibrids. Another advantage of the process of the invention is that the fibrids may be further processed immediately or once they have been treated with an agent suitable for the purpose in hand.

The tangled mass of polyolefin fibrids of the invention may be used, for example, for the manufacture of paper or textile-like webs. To manufacture paper, the fibrids are suspended in, say, water and the aqueous suspension is processed in a paper machine to form sheets of paper. Sheets of paper may alternatively be prepared from mixtures of the polyolefin fibrids and cellulose fibers. The two types of fibers may be blended in any desired proportions. For the preparation of the aqueous suspensions of polyolefin fibrids, dispersing agents are used in amounts of up to 2% by weight, based on the dry weight of the polyolefin fibrids. Suitable dispersing agents are for example melamine-formaldehyde polycondensates prepared by polycondensation of melamine, formaldehyde and aminocarboxylic acids or alkali metal salts thereof in aqueous solution. Another suitable dispersing agent is an anionic protective colloid, which is also used in amounts of up to 2% by weight, based on the dry weight of the polyolefin fibrids. Suitable anionic protective colloids are for example condensates of formaldehyde and the sodium salt of β-naphthalene sulfonic acid, polycondensates of urea, formaldehyde and the sodium salt of phenol sulfonic acid, urea-formaldehyde polycondensates which have been modified with sodium bisulfate or melamine-formaldehyde polycondensates which have been modified with sodium hydrogen sulfite, alkali metal salts of carboxymethyl cellulose, copolymers of maleic acid and vinyl isobutyl ether and ammonium salts of copolymers of styrene and acrylic acid.

Paper webs produced with the polyolefin fibrids of the invention are distinguished by good fiber bonding and high dry and wet strength.

The high degree of fibrillation of the fibrids may be determined, for example, by assessing the freeness by the Schopper-Riegler method (Korn/Burgstaller, "Handbuch der Werkstoffprüfung", 2nd edition, 1953, Vol. 4, "Papier- und Zellstoffprüfung", pp. 388 et seq., published by Springer-Verlag). To carry out this test, the fibrids must be treated with dispersing agents and converted to an aqueous suspension of constant density (2 g/l at 20° C. That amount of water is determined which is retained by the suspended fibrids under specific conditions. The retained amount of water (° Schopper-Riegler, ° SR) is greater, the higher the degree of fibrillation of the fibrids. For example, the Schopper-Riegler values of fibrids of liner polyethylene of the invention are from 15° to 30° SR.

The invention is further described with reference to the following Examples, in which the parts are by weight.

EXAMPLE 1

In a pressure vessel provided with a stirrer, 14 parts of a linear polyethylene having a density of 0.96 g/cm$^3$, a melt index of 4.5 g/10 min (190°/2.16 kg) and a melting point of 130° C are dissolved in a mixture of 51.6 parts of low-boiling naphtha (b.p. 65° to 95° C) and 34.4 parts of pentane consisting of 80 parts of n-pentane and 20 parts isopentane, at 165° C. The autogenous pressure is from 18 to 20 atmospheres gage. This solution is then passed through a pipeline having a length of 120 cm and an internal diameter of 4 mm to enter a cylindrical chamber tangentially, in which the solution is flashed in the precipitant contained in the chamber, this being the same solvent mixture as that in which the polymer is dissolved. The outlet orifice of the tube, through which flashing occurs, is below the surface of the liquid. The liquid boils under reflux, excess heat being removed via a cooler. The mush of fibrids is continuously discharged by way of an overflow. The diameter of the flash chamber is 30 cm and its height is 50 cm, the overflow being provided so as to give a constant level of liquid of about 15 cm.

The mush of fibrids is substantially freed from adhering solvent by filtration. The residual solvent is removed in a dryer by means of a stream of nitrogen at a temperature of from 40° to 45° C. There is obtained a soft loose fibrous product (bulk density 18 g/l), which is opened out on a carding machine to a product having the nature of cotton wool and having a bulk density of 10 g/l. The length of fibrids is from 5 to 25 mm and their thickness is from 3 to 6 μm. The specific surface area is 11.2 m$^2$/g and the degree of fibrillation is found to be 24° SR.

EXAMPLE 2

14 Parts of the linear polyethylene used in Example 1 are melted in a twin-shaft worm kneader. At a point one third of the way along the working portion of the extruder there is added, by means of a metering pump, a mixture of 43 parts of naphtha (b.p. 65° to 95° C) and 43 parts of pentane consisting of 80 parts of n-pentane and 20 parts of isopentane. The pressure measured at the head of the extruder is about 25 atmospheres gage. The polymer solution is passed through a tube having a length of 50 cm and an internal diameter of 6 mm to be relaxed in a cylindrical chamber as described in Example 1 and which it enters tangentially. The flash chamber is filled with the same solvent mixture as that in which the polymer is dissolved. The process is continued as described in Example 1.

There is obtained a soft loose fibrous mass (bulk density 15 g/l) which may be opened out to a free-flowing fibrous product by combing and picking by means of a roll provided with fine teeth. The fibrids have a length of from 5 to 30 mm and a thickness of about 5 μm. The specific surface area was found to be 14.3 m$^2$/g. The Schopper-Riegler value is 22° SR.

EXAMPLE 3

Example 1 is repeated and the same starting materials are used to produce a polyethylene solution in a mixture of naphtha and pentane, which solution contains 15% w/w of polymer. This solution is held at 165° C under a pressure of 18 to 20 atmospheres gage. The solution is flashed through a pipe having a length of 5 m and a diameter of 6 mm, the solution passing tangentially into a cylindrical chamber having a diameter of 3 m and a height of 1 m. This chamber is at the top end of a vertical tube having a diameter of 3 m and a length of 6 m, which tube is cooled. The solvent released by the flash condenses on these cooling surfaces. The fibrids fall down a concentric perforated inner tube having a diameter of 2 m. Nitrogen having a temperature of about 60° C is passed countercurrently through the tube arrangement, at the bottom of which the fibrids are discharged. The fibrids are loose and soft and have a bulk density of 15 g/l and are virtually free from solvent. Their lengths are from 3 to 25 mm and they have a thickness of 5 μm. The fibrids have a specific surface area of 10.2 $m^2/g$ and give a Schopper-Riegler value of 21° SR.

EXAMPLE 4

Example 1 is repeated and 6 parts of polyethylene are dissolved in a solvent mixture of 27 parts of cyclohexane and 67 parts of pentane consisting of 80% w/w of n-pentane and 20% w/w of isopentane, at 165° C. The autogenous pressure is about 10 atmospheres gage. This solution is relaxed at described in Example 1, the liquid precipitant being the same cyclohexane-pentane mixture, this boiling under reflux at from 40° to 45° C. The mush of fibers is substantially freed from adhering solvent by filtration. The residual solvent is removed in a dryer by means of a stream of nitrogen having a temperature of from −0° to −5° C. There is obtained a soft loose fibrous product having a bulk density of 25 g/l. The lengths of the fibrids range from 2 to 20 mm and their thicknesses from 3 to 8 μm.

COMPARATIVE EXAMPLE 1

A linear polyethylene having the physical properties stated in Example 1 and produced by polymerization in solution in cyclohexane is diluted with cyclohexane at 165° C until a solution is obtained which contains 3% w/w of polymer homogeneously dissolved therein. A pressure of from 6 to 7 atmospheres gage is measured above the solution. This solution is flashed as described in Example 1, the liquid precipitant being cyclohexane boiling under reflux at 80 to 81° C. There is obtained an opaque slimy product of a substantially amorphous and gelatinous nature. When the solvent evaporates, the product shrinks considerably to form a hard sheet no longer showing fibrous character. With relatively thick filter cakes, cracks form on drying and a hard crumbly opaque mass is produced.

If the polyethylene concentration is raised to 6 or 14% w/w, there is likewise obtained a gelatinous product, from which, on drying, hard crumbly masses form.

EXAMPLE 5

A linear polyethylene having the physical properties stated in Example 1 is dissolved in low-boiling naphtha (b.p. 35° to 75° C), as described in Example 1. The polyethylene concentration is selected so as to give 8 parts of polymer for every 82 parts of naphtha. The pressure above the solution at 165° C is found to be 15 to 18 atmospheres gage. This solution is flashed as described in Example 1, the liquid precipitant being naphtha (b.p. 35° to 95° C) boiling under reflux at 50° to 55° C. There is obtained a white fibrous product. Following evaporation of the solvent, there is obtained a mass of loose fibrids having a harder handle than those obtained in Example 1. The fibrids have a length of from 5 to 15 mm and a thickness of from 10 to 25 μm. The specific surface area is 26.9 $m^2/g$. The Schopper-Riegler value is found to be 17° SR.

EXAMPLE 6

A linear polyethylene having the physical properties stated in Example 1 is dissolved in a mixture of low-boiling naphtha and pentane so as to give 9 parts of polymer for every 74 parts of naphtha (b.p. 35° to 75° C) and for every 18 part of pentane, this consisting of 60% w/w of n-pentane and 40% w/w of isopentane. The pressure above the solution at 165° C is found to be 18 to 20 atmospheres gage. This solution is flashed in the manner described in Example 1, the liquid precipitant consisting of the same mixture of naphtha and pentane, this boiling under reflux at from 45° to 50° C. The fibrous product is dried as described in Example 1 and there are obtained fibrids having a length of from 2 to 20 mm and a thickness of about 5 μm. The specific surface area is 9.7 $m^2/g$ and the Schopper-Riegler value is 28° SR.

EXAMPLE 7

Example 1 is repeated and the same starting materials are used to produce a polyethylene solution in a mixture of naphtha and pentane, containing 15% w/w of polymer. The pressure above the solution at 165° C is 18 to 20 atmospheres gage. The solution is flashed in a tube having a length of 6 m, a diameter of 8 mm and tapering to 4 mm at its end. Flashing takes place tangentially in a cylindrial chamber having a diameter of 1 m and a height of 0.5 m, this being filled with water up to a level of 15 cm. The outlet end of the tube is about 10 cm below the surface of the water. By continuous addition of fresh water, the temperature of the mush of fibrids is maintained at from 30° to 40° C during flashing. The mush of fibrids is continuously passed to a vaporizer, in which the solvent mixture is distilled off under reduced pressure at a temperature of from 60° to 70° C. The fibrous product is separated from water on a sieve having a mesh width of 0.5 mm.

For the manufacture of paper, the moist fibrous product is placed in water together with cellulose in a ratio of 1:1 by weight, the water containing 2% w/w, based on the dry weight of the polyolefin fibrids, of a dispersing agent, produced by polycondensation of melamine, formaldehyde and the sodium salt of ε-aminocaproic acid. The mush of fibers is milled in a conical refiner. The suspension of milled fibers is used to produce a paper web showing good fiber bonding and high wet and dry strength.

EXAMPLE 8

In a polymerization plant, an ethylene copolymer with n-butylacrylate is prepared by the high-pressure process, which copolymer contains 20% w/w of n-butyl acrylate and has a density of 0.926 $g/cm^3$ and a melt index of 1.6 g/10 min (190°/2.16 kg). The copolymer is produced in the form of a melt. Pentane consisting of 80 parts of n-pentane and 20 parts of isopentane is added to the melt at a temperature of 145° C in a screw extruder so that a solution containing 25% w/w of polymer is obtained. The pressure at the head of the extruder is found to be 20 to 25 atmospheres gage. This solution is passed through a tube having a length of 1.5 mm and an internal diameter of 10 mm tapering to 3 mm at the end of the tube and passes centrally in a vertical tube having a diameter of 2.5 mm and a length of 6 m. Nitrogen is passed countercurrently through the tube arrangement at a temperature of 50° C. Fibrids which are virtually free of solvent are discharged at the bottom of the tube. The solvent vapors entrained by the nitrogen are condensed by cooling and returned to the extruder.

The fibrids are soft and elastic and have a bulk density of 20 to 25 g/l. Their lengths are found to be from 3 to 40 mm and their thicknesses from 5 to 15 μm.

EXAMPLE 9

Example 1 is repeated, and 20 parts of polyethylene having a density of 0.918 $g/cm^3$ and a melt index of 1.5 g/10 min (190° C/2.16 kg) are dissolved, at 145° C in a pressure vessel, in 80 parts of pentane consisting of 80 parts of n-pentane and 20 parts of isopentane. A pressure of about 18 atmospheres gage is measured above this solution. The solution is flashed as in Example 8 and it is dried with a countercurrent of nitrogen at 60° C. There is obtained a fibrous product which is soft and has the nature of cotton wool. It has a bulk density if about 15 g/l and the length of the fibrids is from 5 to 20 mm, the thickness of the fibrids being 5 μm.

We claim:

1. A process for the manufacture of discrete fibrids of polyethylene having lengths of 1 to 50 mm and thicknesses between 2 and 30 μm which comprises (a) dissolving in a pressure vessel polyethylene, obtained by low-pressure polymerization of ethylene, in a solvent which is a mixture of pentanes and a naphtha cut boiling at 25° to 140° C. and containing pentanes in an amount of from 5 to 50% by weight, said pentanes being selected from the group consisting of n-pentane, isopentane, cyclopentane and neopentane, (b) maintaining the vapor pressure in said pressure vessel at 4 to 60 atmospheres and maintaining the temperature of the polyolefin solution in said pressure vessel at temperature of 80° 250° C and above the boiling point of said solvent at standard pressure, (c) passing said polyethylene solution from said pressure vessel through an orifice into a space maintained at lower temperature and pressure than those in said pressure vessel, (d) flashing off said solvent in said space from the solution passed through said orifice to produce a tangled mass of said fibrids, said amount of said pentanes in said solvent further being sufficient to cause the polyethylene to separate in form of discrete fibrids upon the flashing off of said solvent in said space, and (e) drying the resultant polyethylene fibrids.

2. A process as claimed in claim 1, and the further step of disentangling the dried fibrids by combing, brushing or picking to obtain a free flowing and transportable mass of said polyethylene fibrids having said lengths and said thicknesses.

3. A process as claimed in claim 1, wherein said polyethylene has a density in the range of 0.915 to 0.965 g/cm$^3$.

4. A process as claimed in claim 1, wherein said polyethylene has a melt index (as determined by ASTM D 1238-65 T at 190° C and a load of 2.16 kg) in the range of 100 g/10 minutes to 0.01 g/10 minutes.

* * * * *